United States Patent [19]

Ross

[11] Patent Number: 4,984,303

[45] Date of Patent: Jan. 15, 1991

[54] RAIN CHAPS

[76] Inventor: Stanley M. Ross, 8925-135A Street, Surrey, B.C., Canada, V3V 5V2

[21] Appl. No.: 472,267

[22] Filed: Jan. 30, 1990

[51] Int. Cl.[5] ..... A41D 3/00

[52] U.S. Cl. ..... 2/227; 2/22; 2/51; 2/82

[58] Field of Search ..... 2/2, 22, 23, 46, 47, 2/48, 51, 69, 79, 82, 227, 229, 235, 236, 237

[56] References Cited

U.S. PATENT DOCUMENTS

| | | | |
|---|---|---|---|
| 556,530 | 3/1896 | Chandler | 2/227 |
| 1,105,569 | 7/1914 | Lacrotte | 2/2 |
| 3,517,394 | 6/1970 | Robinson | 2/51 |
| 3,981,026 | 9/1976 | Reverberi | 2/82 |
| 4,110,845 | 9/1978 | Chellis | 36/2 R |
| 4,266,299 | 5/1981 | Beal | 2/227 |
| 4,458,363 | 7/1984 | Harvey | 2/22 |
| 4,506,391 | 3/1985 | Rodman | 2/227 |
| 4,665,562 | 5/1987 | Winer | 2/22 |
| 4,697,286 | 10/1987 | Cho | 2/51 |

FOREIGN PATENT DOCUMENTS

| | | | |
|---|---|---|---|
| 246422 | 5/1912 | Fed. Rep. of Germany | 2/227 |
| 2475861 | 8/1981 | France | 2/46 |
| 400222 | 10/1933 | United Kingdom | 2/69 |

*Primary Examiner*—Werner H. Schroeder
*Assistant Examiner*—Diana L. Biefeld
*Attorney, Agent, or Firm*—Shlesinger & Myers

[57] ABSTRACT

A set of rain chaps which includes a belt for attachment around a waist of a wearer, a pair of leg portions affixed to the belt, having a lower substantially rectangular portion with an elongated inside edge of one leg portion extending from an ankle region to an upper thigh region of a wearer. The elongated inside edge overlaps a substantial portion of another of the leg portions, and an arcuate edge joins an upper region of the inside edge to approximately midway of the belt for each of the leg portions. A pair of straps are affixable to the belt at a back of the wearer and attached to corresponding ones of the upper region of each of the leg portions so that each of the upper regions of the leg portions is pulled upwardly and rearwardly so as to prevent rotation of said leg portions proximate the bottom. Strap means are provided for attaching the leg portions around a leg of a wearer.

13 Claims, 6 Drawing Sheets

RAIN CHAPS

FIELD

The present invention relates to detachable rain chaps for protecting the front side of a wearer from the waist down against rain or from frontal contact with wet objects.

BACKGROUND

Protective rain chaps which fit over the regular clothes of a wearer to protect the latter during activities such as loading and unloading trucks, walking through undergrowth, and riding motorcycles or bicycles are known in the art. U.S. Pat. No. 4,110,845 issued to Chellis discloses a set of rain chaps supported by means of straps to a belt around the waist and fastened around each leg along a longitudinal seam by snap fasteners. Enclosing the legs entirely necessarily reduces freedom of movement. Chellis provides little protection to the hip area.

U.S. Pat. No. 4,266,299 issued May 12, 1981 to Beal discloses a protective garment that includes leg coverings that cover the front of the thighs and fasten around the knee. No protection is provided for the legs below the knees.

U.S. Pat. No. 4,458,353 issued to Harvey on July 10, 1984 discloses a rain garment to protect the front of the legs of a cyclist consisting of two leg coverings with elastic down each longitudinal edge extending from foot inserts to a waist band. A single strap around the back over the upper portion of each thigh serves to hold the leg portions in place. A single interior apron covers an open area between the leggings from the waist to the crotch. Utilizing foot inserts creates the disadvantage of limiting the amount of walking possible without wearing out and unduly soiling the inserts Moreover, a single loose apron flap inadequately protects the crotch area due to the tendency of the apron to move with movement of the wearer. Finally utilizing only a single strap allows the knee portion of the garment to easily become dislodged.

U.S. Pat. No. 4,506,391 issued on Mar. 26, 1985 to Rodman discloses a set of chaps consisting of two leg enclosing portions and two upper portions or overlapping flaps for protecting the front area below the waist. A longitudinal zipper is used to attach and remove the leg enclosing portions. Each flap is held in place by a respective pocket at a top of an associated leg portion. Overlap of the flaps is accomplished by a sideways projecting section of one flap extending over to the other. Thus, the flap material must be reasonably rigid otherwise the projecting section would simply hang down and not serve its protective function. The preferred material is stated as being heavy leather.

U.S. Pat. No. 4,665,562 issued on May 19, 1987 to Winer discloses a leg protector consisting of a rectangular main section for enclosing the calf and ankle of a wearer and a pair of spaced apart straps with a hooked material on one set of upper and lower straps and a corresponding napped material on the other set for detachably engaging associated hooked material.

U.S. Pat. No. 3,981,026 issued on Sept. 21, 1976 to Reverberi discloses a waterproof garment consisting of an assembly of preformed, permanent, parallel folds. When the garment is folded it forms into a belt-like shape that can be worn around the waist of a user. The garment is folded up to a pair of parallel set of snaps and then the snaps on one side are snapped onto the snaps of the other. Otherwise the garments are like regular clothing.

Accordingly, it is an object of the invention to provide an improved set of rain chaps. It is a further object of the invention to provide a set of rain chaps which can be readily attached, detached and stored on the wearer. It is yet a further object of the invention to provide a set of rain chaps that provide improved protection to the wearer in combination with greater freedom of movement.

SUMMARY OF THE INVENTION

According to the invention there is provided a set of rain chaps which includes a belt, a pair of rectangular-shaped leg portions affixed to the belt and extending along substantially the entire length of a wearer's leg, means for attaching and detaching the leg portions around a wearer's leg, and a pair of overlapping flaps affixed to the belt and attachable to respective inside upper corners of the leg portions. Means are also provided for retaining the chaps in a rolled up condition around the belt so that it can be worn around the waist when not in use.

By providing two substantially independent leg portions, ample freedom of movement is achieved for physical activities such as stepping over objects, bicycling, or climbing.

Preferably, a pair of frontal, overlapping, tapered flaps affixed to said belt and hanging down with a narrow end of each of the flaps attachable to an upper region of the inside edge of a corresponding one of said leg portions so that a frontal area of a wearer between said leg portions is protected. The two overlapping flaps hinged to respective leg portions at their ends allows much greater freedom of movement than if the leg portions were simply continued up as one piece. At the same time such a structure is capable of providing an overlap which keeps the wearer protected even during movement in which each flap moves with respect to the other in a scissor-like movement.

Preferably, for rainwear the material used for the chaps is a lightweight water-impervious vinyl or plastic. However, the material may differ for different applications. For example, leather may be used for heavy wear conditions or canvas for dry, industrial use. The attaching and detaching means may be straps one set positioned near the bottom and another set above the knees and a third pair of straps attachable between the belt and respective inside upper corners of the leg portions so as to hold the inside of the leg portions snugly around each leg of a wearer and away from each other.

BRIEF DESCRIPTION OF THE DRAWINGS

The novel features believed characteristic of the invention are set forth in the appended claims. The invention itself, however, as well as other features and advantages thereof, will be best understood by reference to the detailed description which follows, read in conjunction with the accompanying drawings, wherein:

DETAILED DESCRIPTION WITH REFERENCE TO THE DRAWINGS

Figure 1:
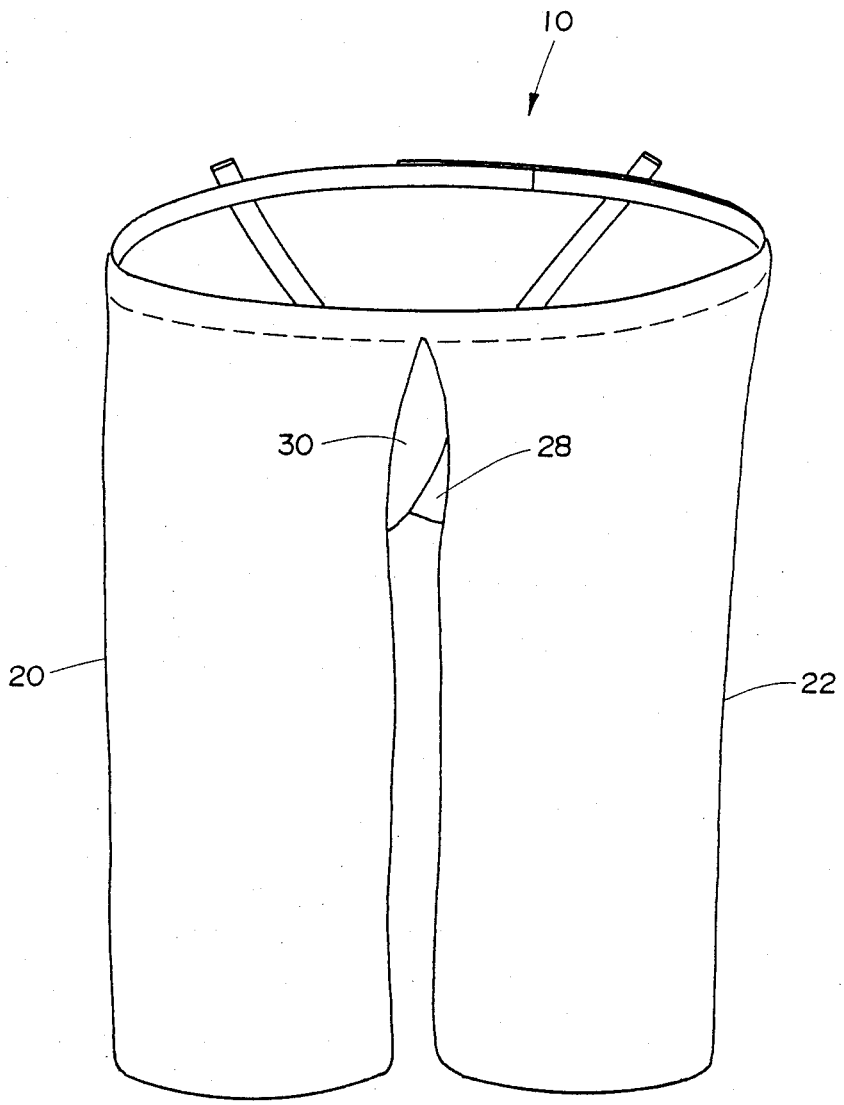
FIG. 1 is a perspective view showing the front of the rain chaps in use but without a wearer.
Figure 2:
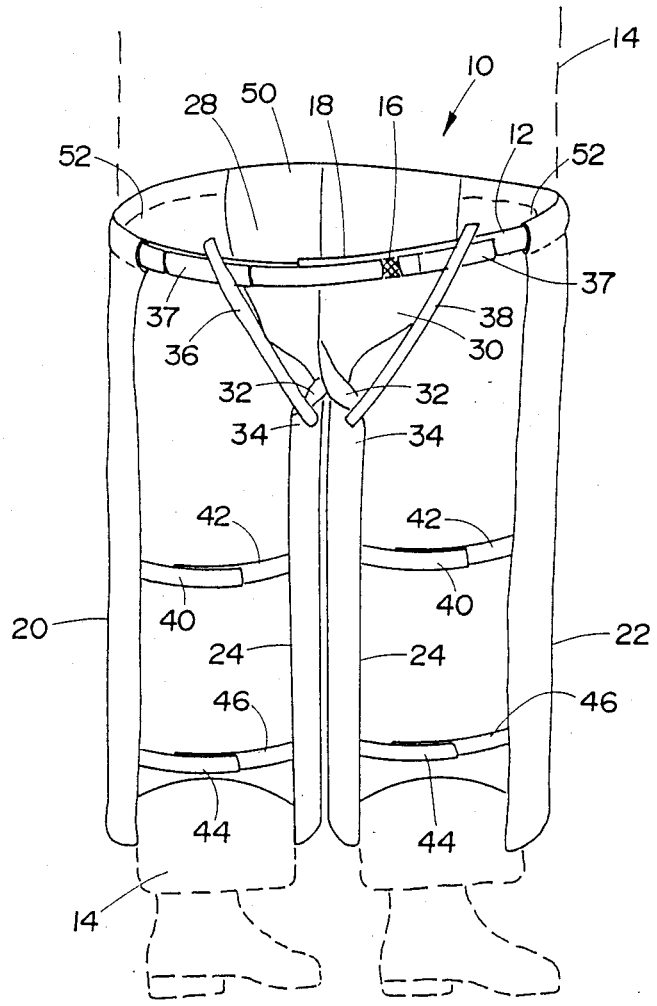
FIG. 2 is a perspective view showing the rear of the rain chaps in use.

Referring to FIGS. 1 to 4, the rain chaps 10 are formed by a belt 12 attached around the waist of a wearer 14 (see FIG. 3) by engaging a connective material 16 on one end of the belt 12 with a connective material 18 on the other. A suitable connective material is a hermaphroditic material such as that sold under the trademark VELCRO. Leg portions 20 and 22 are affixed to the belt 12 and when in flat form overlap with an inside edge 24 of one reaching approximately midway across the width of an adjacent leg portion. An arcuate edge 26 on each of leg portions 20 and 22 joins an a corresponding inside edge 24 to the belt 12. A pair of overlapping flaps 28 and 30 in the shape of opposed arcuate wedges are affixed to the belt 12 and extend down attaching at their ends 32 to corresponding upper corners 34 of associated inside edges 24 of each leg portion 20 and 22.

Figure 3:
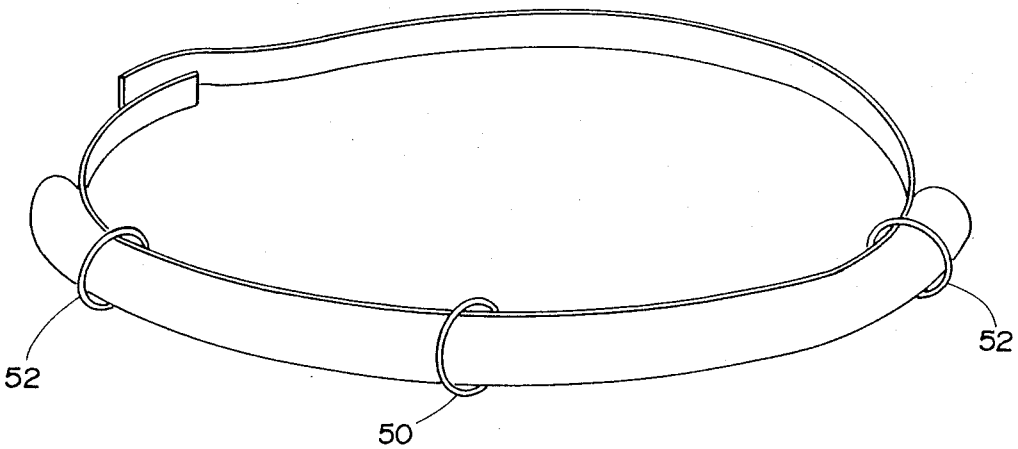
FIG. 3 is perspective view showing the rain chaps in folded up form worn as a belt around a wearer and FIG. 4 is a side elevation view showing a central fastener strap for attachment around a rolled up set of chaps.
Figure 4:
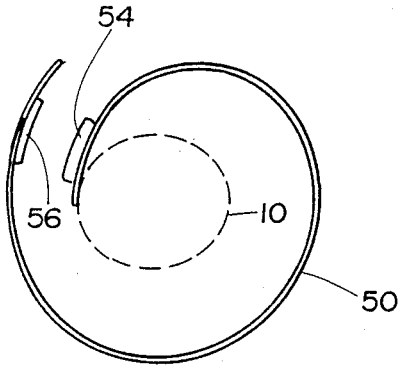
Figure 5:
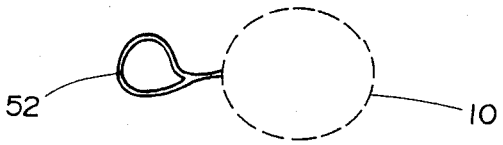
FIG. 5 is a side elevation view showing a side loop for attachment around a rolled up set of chaps.
Figure 6:
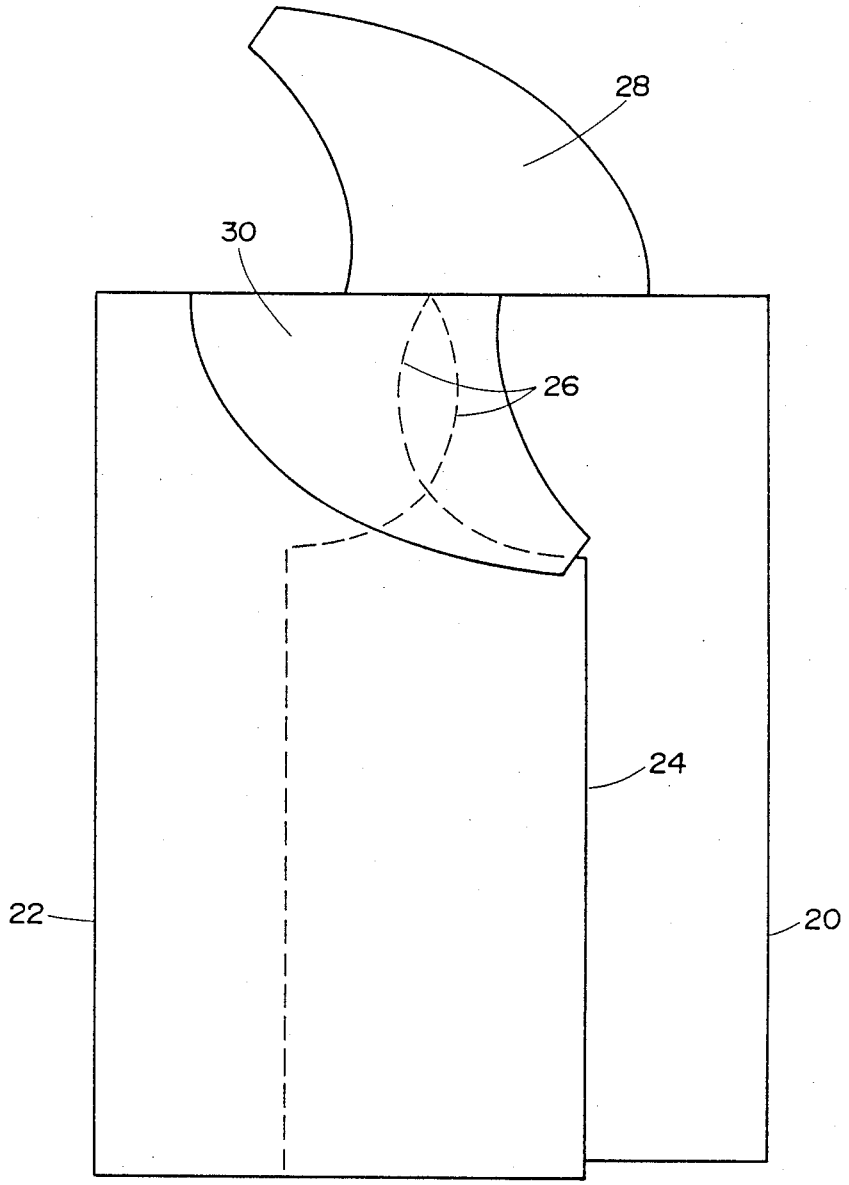
FIG. 6 is a view showing the front of the rain chaps in flat form.

A pair of straps 36 and 38 are attached to respective corners 34 and are attachable to belt 12 so as to pull the inside of leg portions 20 and 22 upwardly and snugly against the insides of the legs of a wearer 14. Straps 36 and 38 control the way the leg portions 20 and 22, respectively, hang on the body of the wearer 14. A different placement of straps 36 and 38 than that shown would result in misalignment or rotation of the leg portion 20 and 22 near the bottom of thereof. Attachment to the belt 12 is also by engagement of a connective material on the straps 36 and 38 with sections of connective material 37 on belt 12. Similarly, straps 40 and 42 around the lower thigh and straps 44 and 46 around the lower calf of a wearer 14 are adjustably attached by engagement of connective material on straps 40 and 44 with corresponding connective material on straps 42 and 46, respectively. As shown in FIG. 5, loops 52 which are elastic serve to hold the chaps 10 in a rolled up condition when they are to be stored or worn around the waist of a wearer 14 as seen in FIG. 3. They are stretched over each end of the folded up garment. Fastener 50 seen in FIG. 4 is formed of a single length of elastic material each having connective material so as to enable it to be connected onto itself together and form a loop surrounding the middle of the chaps when rolled up.

Figure 7:
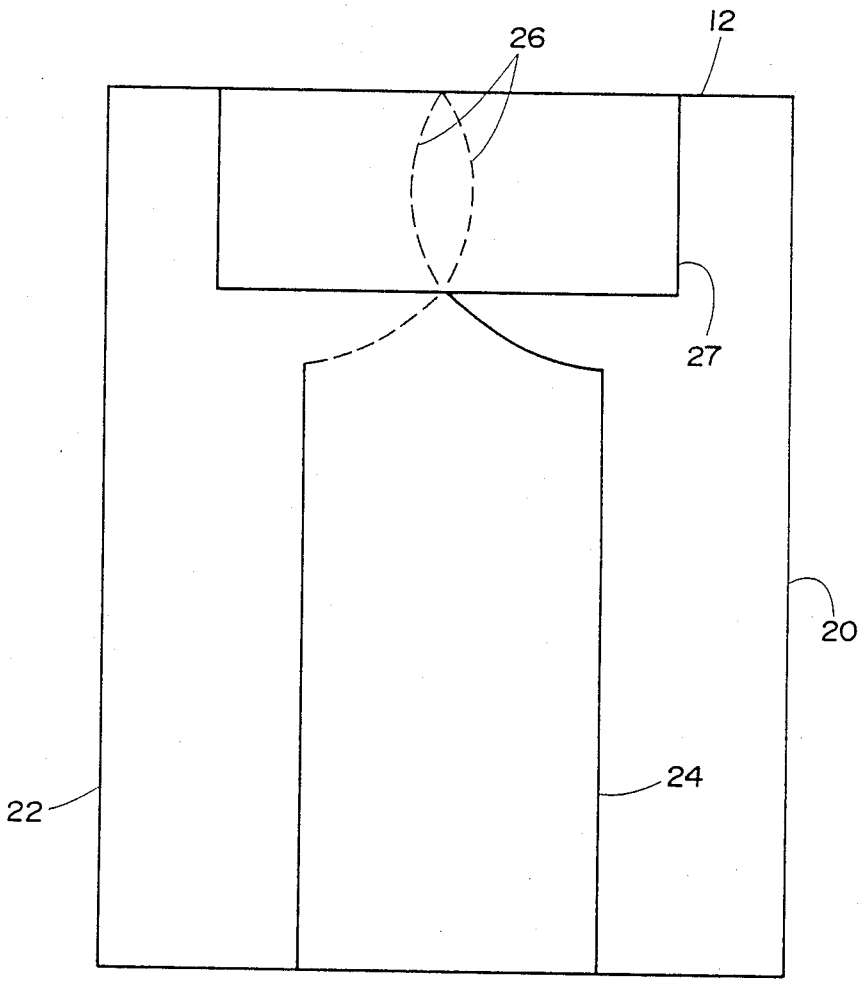
FIG. 7 is a front elevation view of a set of rain chaps with a modified frontal flap.

Optionally, as shown in FIG. 7 a single flap 27 may be employed which hangs down from the center without being attached at its bottom other than to the belt 12 in order to provide protection to a wearer without impeding movement. In addition, the two outer loops may be replaced by lengths of elastic such as in fastener 50.

Accordingly, while this invention has been described with reference to illustrative embodiments, this description is not intended to be construed in a limiting sense. Various modifications of the illustrative embodiments of the invention will be apparent to persons skilled in the art upon reference to this description. It is therefore contemplated that the appended claims will cover any such modifications or embodiments as fall within the true scope of the invention.

I claim:

1. A set of rain chaps, comprising:

(a) a belt for attachment around a waist of a wearer;

(b) a pair of leg portions affixed to said belt, having a lower substantially rectangular portion with an elongated inside edge of one leg portion extending from an ankle region to ADB waist region of a wearer, overlapping a portion of another of said leg portions, and an arcuate edge joining an upper region of said inside edge to approximately midway of said belt for each of said leg portions;

(c) a pair of straps affixable to said belt at a back of said wearer and attached to corresponding ones of the upper region of each of said leg portions so that each of the upper regions of the leg portions is pulled upwardly and rearwardly so as to avoid rotation of said leg portions proximate the bottom; and (d) strap means for attaching said leg portions around a leg of a wearer.

2. A set of rain chaps according to claim 1, including a pair of frontal, overlapping, flaps affixed to said belt and hanging down attachable to an upper region of the inside edge of a corresponding one of said leg portions so that a frontal area of a wearer between said leg portions is protected and so that upon walking movement by a wearer, said flaps slide over one another.

3. A set of rain chaps according to claim 2, including tying means affixed to said belt for tying up said chaps when rolled up against said belt so that said chaps can be carried in a rolled up condition around a wearer's waist.

4. A set of rain chaps according to claim 2, wherein said flaps are opposed and arcuate-shaped.

5. A set of rain chaps according to claim 1, wherein said strap means are a pair of straps extending around a thigh region and an ankle region of said leg portions and having connective regions on each of said straps for mutual engagement.

6. A set of rain chaps according to claim 1, wherein said chaps are made of a lightweight vinyl material.

7. A set of rain chaps according to claim 3, wherein said tying means includes a pair of elastic loops affixed to said belt region at either end of a waist region and a strap with connective means for attachment to itself to form a loop around said chaps when in a rolled up condition, said strap affixed to said waist region intermediate ends thereof.

8. A set of rain chaps according to claim 1, including a frontal flap affixed to said belt and hanging down to cover a frontal region of the wearer.

9. A set of rain chaps, comprising:

(a) a belt for removable attachment around a waist of a wearer;

(b) a pair of leg portions affixed to said belt, having a lower substantially rectangular portion with an elongated inside edge of one leg portion extending from an ankle region to an upper thigh region of a wearer, overlapping approximately one half the width of another of said leg portions, and an arcuate edge joining an upper region of said inside edge to approximately midway of said belt for each of said leg portions;

(c) flap means for covering a frontal region of a wearer;

(d) a pair of straps affixable to said belt at a back of said wearer and attached to corresponding ones of the upper region of each of said leg portions so that each of the upper regions of the leg portions is pulled inwardly against an inside of a wearer's thigh and upwardly so as to fit snugly against a wearer;

(e) strap means for attaching said leg portions around a leg of a wearer; and (f) tying means affixed to said belt for maintaining said chaps in a rolled up condition adjacent said belt when not in use.

10. A set of rain chaps according to claim 8, wherein said strap means includes a set of straps located at a thigh region of said leg portions and a set of straps located at a calf region of said leg portions.

11. A set of rain chaps according to claim 9, wherein said flap means is a pair of frontal, overlapping, tapered flaps affixed to said belt and hanging down with a narrower end of each of said flaps attachable to an upper region of the inside edge of a corresponding one of said leg portions so that a frontal area of a wearer between said leg portions is protected and so that on movement of a wearer, said flaps slide over one another.

12. A set of rain chaps according to claim 8, wherein said flaps are each arcuate and opposed to each other.

13. A set of rain chaps according to claim 9, including a frontal flap affixed to said belt and hanging down to cover a frontal region of the wearer.

* * * * *